US008957602B2

(12) United States Patent
Zhang et al.

(10) Patent No.: US 8,957,602 B2
(45) Date of Patent: Feb. 17, 2015

(54) CORRELATED COLOR TEMPERATURE CONTROL METHODS AND DEVICES

(75) Inventors: Wanfeng Zhang, Palo Alto, CA (US); Pantas Sutardja, Los Gatos, CA (US)

(73) Assignee: Marvell World Trade Ltd., St. Michael (BB)

( * ) Notice: Subject to any disclaimer, the term of this patent is extended or adjusted under 35 U.S.C. 154(b) by 174 days.

(21) Appl. No.: 13/548,797

(22) Filed: Jul. 13, 2012

(65) Prior Publication Data

US 2013/0020956 A1 Jan. 24, 2013

Related U.S. Application Data

(60) Provisional application No. 61/509,001, filed on Jul. 18, 2011.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 33/086* (2013.01)
USPC ..... 315/294; 315/291; 315/297; 315/307

(58) Field of Classification Search

None
See application file for complete search history.

(56) References Cited

U.S. PATENT DOCUMENTS

| | | | | |
|---|---|---|---|---|
| 8,283,874 | B2 * | 10/2012 | Buelow et al. | 315/291 |
| 8,378,588 | B2 * | 2/2013 | Kuo et al. | 315/291 |
| 2006/0202915 | A1 | 9/2006 | Chikugawa | |
| 2008/0224631 | A1 | 9/2008 | Melanson | |
| 2011/0031890 | A1 | 2/2011 | Stack | |
| 2012/0038291 | A1 * | 2/2012 | Hasnain | 315/294 |

FOREIGN PATENT DOCUMENTS

| | | | |
|---|---|---|---|
| EP | 2 375 861 | A2 | 10/2011 |
| WO | WO 2010/103480 | A2 | 9/2010 |
| WO | WO 2012/044223 | A1 | 4/2012 |

OTHER PUBLICATIONS

International Search Report issued in International Application No. PCT/US2012/046665.

* cited by examiner

*Primary Examiner* — Douglas W Owens
*Assistant Examiner* — Dedei K Hammond

(57) ABSTRACT

New and useful methods and systems for providing lighting control are disclosed. For example, in an embodiment a lighting system includes one or more first solid state lights having a first aesthetic color, one or more second solid state lights having a second aesthetic color, the second aesthetic color having an appreciably longer wavelength than the first aesthetic color, and an amplitude correlation circuit configured to control a ratio of first light produced by the one or more first solid state lights to second light produced by the one or more second solid state lights as a function of a received dimming control signal.

22 Claims, 5 Drawing Sheets

CORRELATED COLOR TEMPERATURE CONTROL METHODS AND DEVICES

INCORPORATION BY REFERENCE

This application claims the benefit of U.S. Provisional Application No. 61/509,001 entitled "New correlated color temperature (CCT) control method with dual string LED driver" filed on Jul. 18, 2011, the content of which is incorporated herein by reference in its entirety.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Triac dimmers for incandescent light bulbs have been the traditional light dimming solution over the last half century. However, Solid State Lighting (SSL), because of its low-power requirements and other advantages, is fast becoming the next mainstay of light solutions. Issues that arise with the new lighting technology include how to make SSLs compatible with existing lighting fixtures and controls, and how to affect the ergonomics of SSLs to appear more pleasing to consumers.

SUMMARY

Various aspects and embodiments of the invention are described in further detail below.

In an embodiment, a lighting system includes one or more first solid state lights having a first aesthetic color, one or more second solid state lights having a second aesthetic color, and an amplitude correlation circuit configured to control a ratio of first light produced by the one or more first solid state lights to second light produced by the one or more second solid state lights as a function of a received dimming control signal.

In another embodiment, a lighting control method includes receiving a dimming control signal, and based on the dimming control signal, producing an amplitude control signal configured to control a ratio of first light produced by one or more first solid state lights having a first aesthetic color to second light produced by one or more second solid state lights having a second aesthetic color.

BRIEF DESCRIPTION OF THE DRAWINGS

Various embodiments of this disclosure that are proposed as examples will be described in detail with reference to the following figures, wherein like numerals reference like elements, and wherein.

DETAILED DESCRIPTION OF EMBODIMENTS

The disclosed methods and systems below may be described generally, as well as in terms of specific examples and/or specific embodiments. For instances where references are made to detailed examples and/or embodiments, it is noted that any of the underlying principles described are not to be limited to a single embodiment, but may be expanded for use with any of the other methods and systems described herein as will be understood by one of ordinary skill in the art unless otherwise stated specifically.

As stated above, Solid State Lighting (SSL) is fast becoming the next mainstay of light solutions. There are some challenges in this technology in that it may be advantageous to make SSLs compatible with triac dimmers and to precisely be able to control color and intensity. For example, consumers might expect and desire SSLs to mimic incandescent lights for any stage of dimming. For instance, when an incandescent light's output is high, the Correlated Color Temperature (CCT) can be about 2800 k, but as the light dims the CCT decreases to around 1800K. Such changes in CCT are easily perceptible to the human eye.

Figure 1:
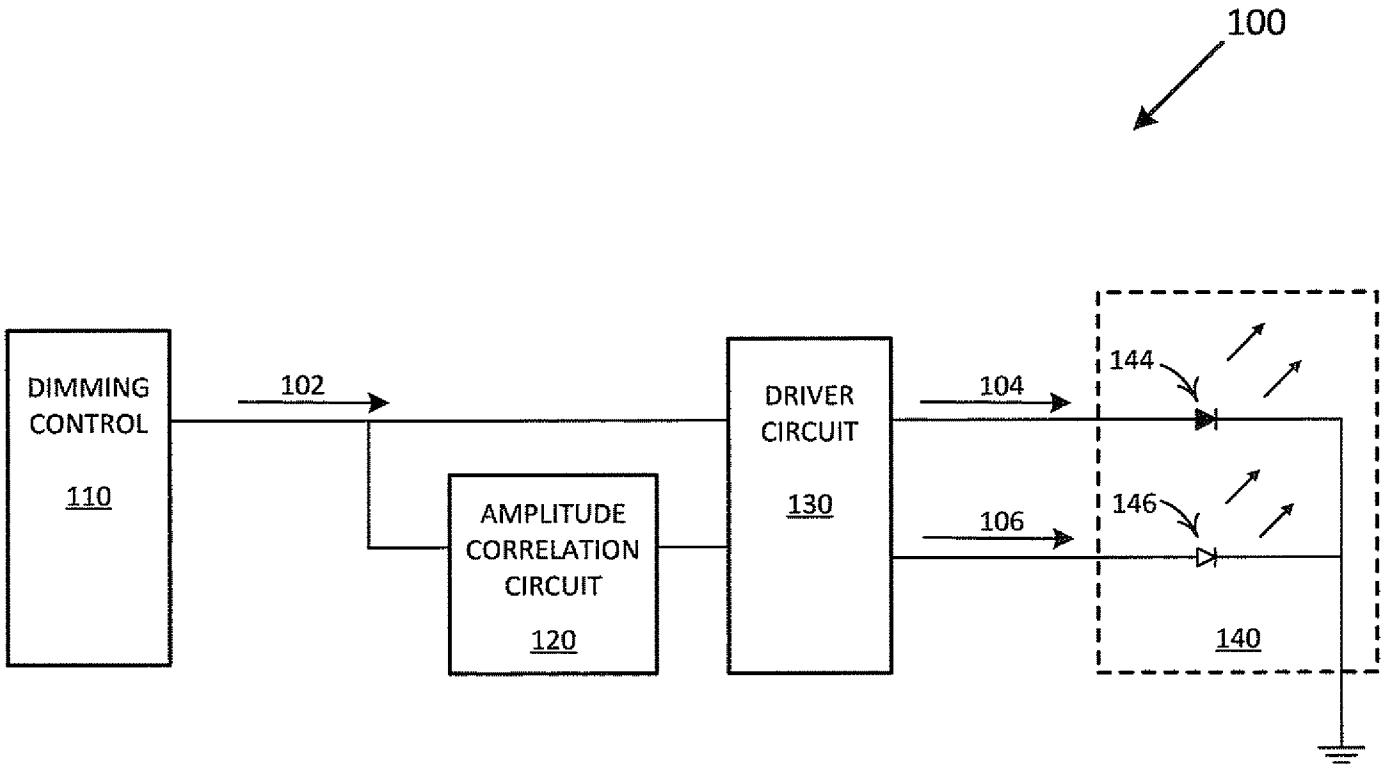
FIG. 1 is an example of a multi-color LED lighting system capable of correlated color temperature adjustment.

FIG. 1 is an example of a multi-color Light Emitting Diode (LED) lighting system 100 capable of correlated color temperature adjustment. The lighting system 100 includes a dimming control 110, an amplitude correlation circuit 120, a driver circuit 130 and a multicolor LED source 140 with the a multicolor LED source 140 including a (first) cool-color LED 144 and a (second) warm-color LED 146.

It is to be appreciated that the particular hues of the cool-color LED 144 and the warm-color LED 146 can change from embodiment to embodiment. For example, the cool-color LED 144 may be any number of aesthetically "cool" colors, such as white, blue, green and yellow. Similarly, the warm-color LED 146 may be any number of aesthetically "warm" colors, such as red, orange and amber. The selected warm colors will have an appreciably noticeable overall longer wavelength than the selected cool aesthetic color. The particular combination of cool and warm colors is a design choice that may be determined based on any number of aesthetic or technical factors.

It is also to be appreciated that the cool-color LED 144 and the warm-color LED 146 can each be a single LED or a plurality of LEDs. For example, in an embodiment, the cool-color LED 144 may consist of ten white LEDs while the warm-color LED 146 may consist of six red LEDs interlaced with the white LEDs.

In operation, the dimming control 110, under control of a human or computer-based operator, sends a dimming control signal 102 to the amplitude correlation circuit 120 and the driver circuit 130. In the present embodiment, the dimming control 110 can be a conventional triac-based circuit using an AC power source with the dimming control signal 102 being a pulse-width modulated (PWM) signal. However, the particular configuration of the dimming control 110 can vary from embodiment to embodiment as may be considered necessary or otherwise desirable. Similarly, while the example pulse-width-modulated signal 102 is a PWM signal, in differing embodiments the dimming control signal 102 can take a multitude of forms including, but not limited to, a voltage level, a signal modulated according to any known or later developed modulation scheme, or a digital number.

The amplitude correlation circuit 120 receives the dimming control signal 102, processes the dimming control signal 102 and produces an amplitude control signal that is provided to the driver circuit 130.

In an embodiment, the amplitude correlation circuit 120 produces the amplitude control signal according to a predetermined transfer function designed to provide warm LED light and cool LED light in ratios correlated to the overall power of the dimming control signal 102. For example, as a PWM-based dimming control signal 102 increases in duty cycle, amplitude correlation circuit 120 can cause the relative ratio of cool LED light to warm LED light to increase according to any number of predetermined transfer functions as will be demonstrated below.

The driver circuit 130 receives the amplitude control signal from the amplitude correlation circuit 120, as well as the dimming control signal 102 from the dimmer control 110, to produce a number of LED drive signals including a cool-color drive signal 104 that drives the cool-color LED 144, and a warm-color drive signal 106 that drives the warm-color LED 146.

Figure 2:
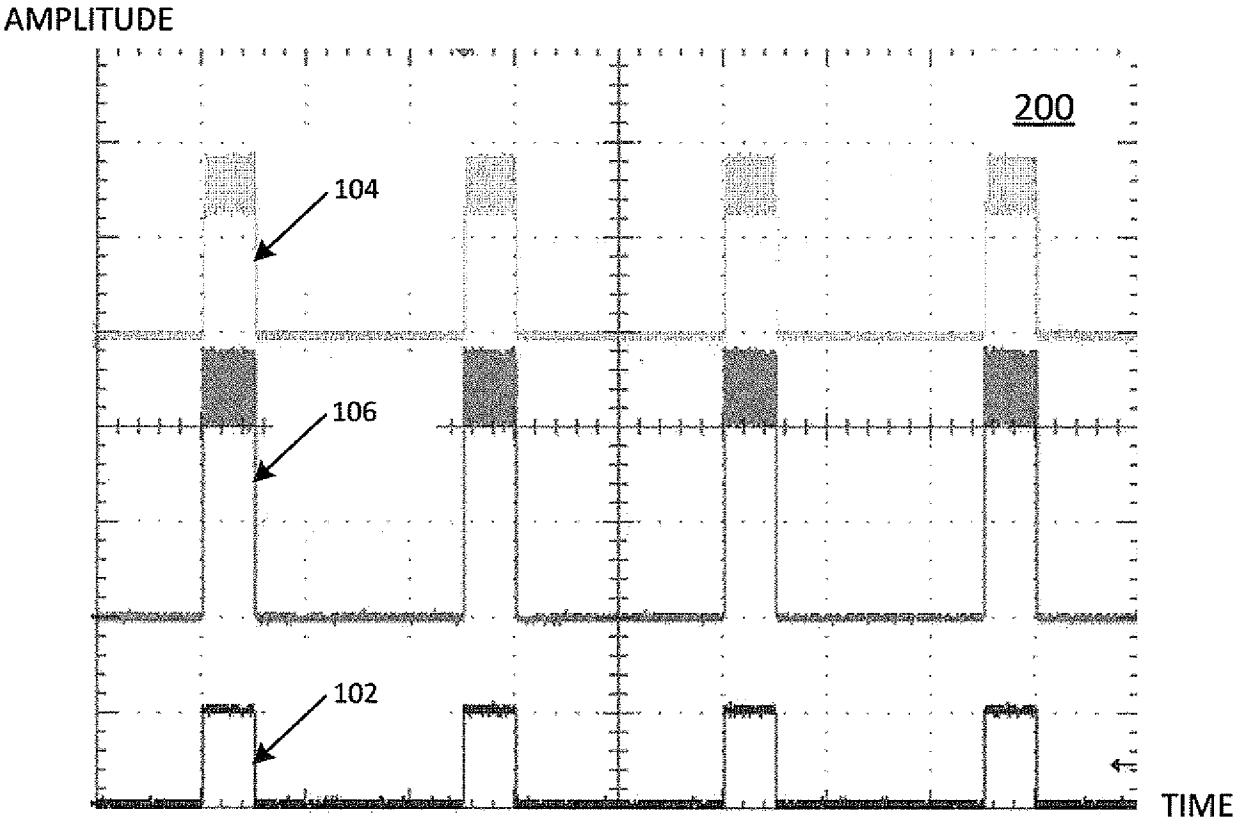
FIG. 2 depicts a pulse width modulated (PWM) control signal and two resultant PWM drive signals capable of driving a multi-color LED lighting system according to a correlated color temperature adjustment.

FIG. 2 is a display 200 depicting an exemplary pulse width modulated (PWM) dimming control signal 102 (bottom) and two resultant PWM drive signals including the aforementioned cool-color drive signal 104 (measured as current) that drives the cool-color LED 144 and the warm-color drive signal 106 (measured as current) that drives the warm-color LED 146. As can be see in FIG. 2, each of the signals 102, 104 and 106 has a distinct duty cycle with the duty cycle of the cool-color drive signal 104 and the warm-color drive signal 106 being determined based on the dimming control signal 102. The amplitude ratio of the cool-color drive signal 104 to the warm-color drive signal 106 can be controlled by the amplitude correlation circuit 120 as a function of duty cycle as will be further demonstrated below.

Figure 3:
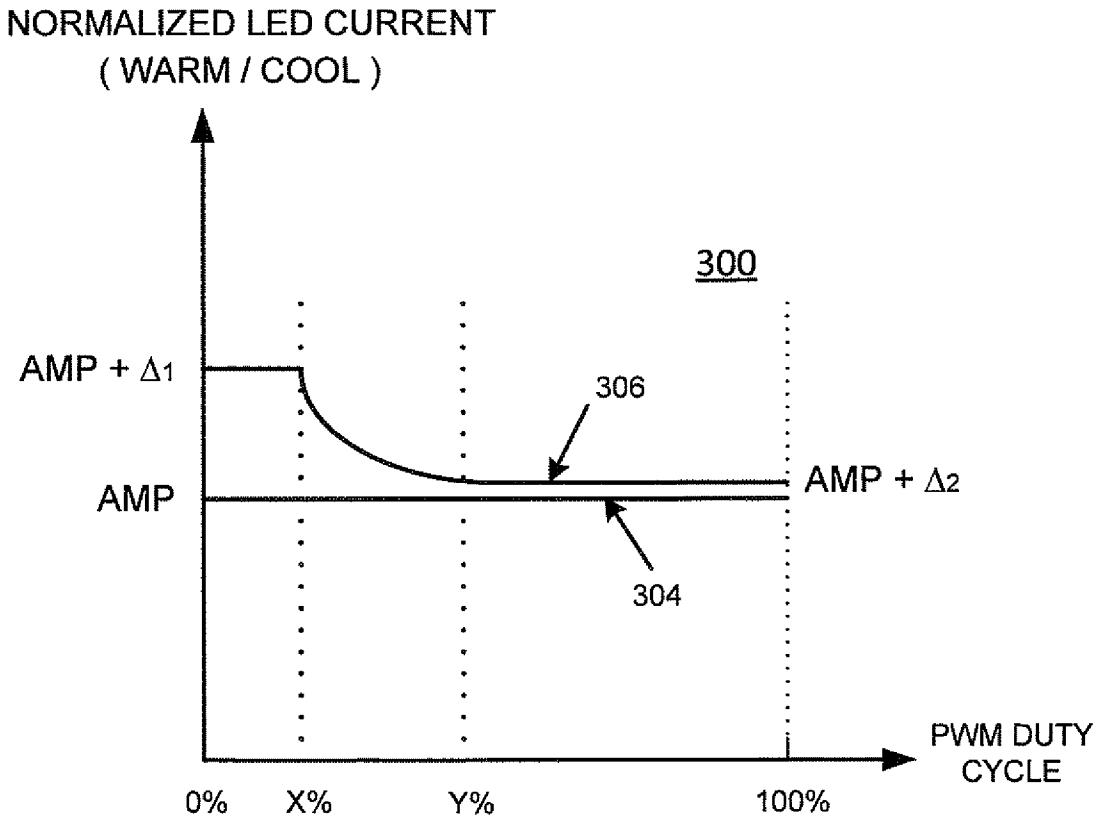
FIG. 3 is a first example of respective drive currents for PWM drive circuitry capable of driving a multi-color LED lighting system according to a correlated color temperature adjustment.

FIG. 3 is an example transfer function 300 of respective drive currents for a cool-color drive signal 304 and a warm-color drive signal 306 that vary as a function of duty cycle, In the present example, the drive current for the cool-color drive signal 304 (during on periods) is fixed to an amount AMP across a duty cycle indicative of a dimming level and ranging from 0% to 100%. In contrast, the drive current for the warm-color drive signal 306 varies relative to the drive current for the cool-color drive signal 304. In the example of FIG. 3, duty cycle is divided into three region: 0% to X %; X % to Y %; and Y % to 100%. The example transfer function for the warm-color drive signal 306 is constant across 0% to X % and Y % to 100%, but varies asymptotically between X % to Y %.

The overall transfer function of the example warm-color drive signal 306, however, is but one of many possibilities and should be considered non-limiting. It is to be observed in view of the example of FIG. 3 that the amount of cool-color light will generally increase relative to that of the warm-color light as duty cycle decreases.

It is also to be appreciated that the overall transfer function can be modeled to optimize, approximate or at least provide improvement on the Color Rendering Index (CRI) of the resultant light so as to reproduce or approximate any number of man-made or natural light sources, such as an incandescent light, ambient natural light in a desert, or even a combination thereof.

It is further to be appreciated that it can be advantageous to make the transfer function time-dependent or switchable. For example, during hours where awareness and productivity are critical, it can be useful for a light source to produce very bright, narrow-band white light regardless of overall intensity/duty-cycle while during leisure hours it may be preferable to have a transfer function that mimics sunlight for various stages of the day.

Figure 4:
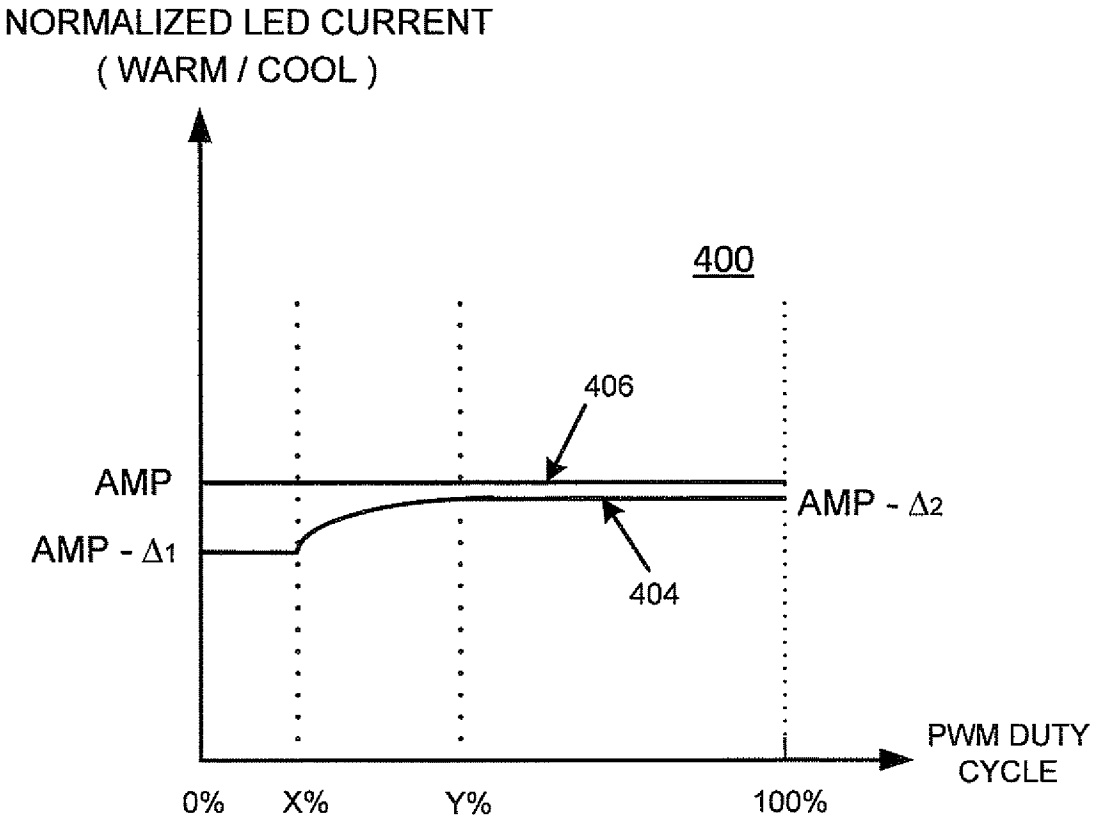
FIG. 4 is a second example of respective drive currents for PWM drive circuitry capable of driving a multi-color LED lighting system according to a correlated color temperature adjustment.

FIG. 4 is a second example transfer function 400 of respective drive currents for a cool-color drive signal 404 and a warm-color drive signal 406 that vary as a function of duty cycle. In the example of FIG. 4, the drive current for the warm-color drive signal 406 is fixed at current level AMP while the drive current for the cool-color drive signal 404 varies, but the overall effect of varying CCT as a function of duty cycle while maintaining CRI can be accomplished.

Figure 5:
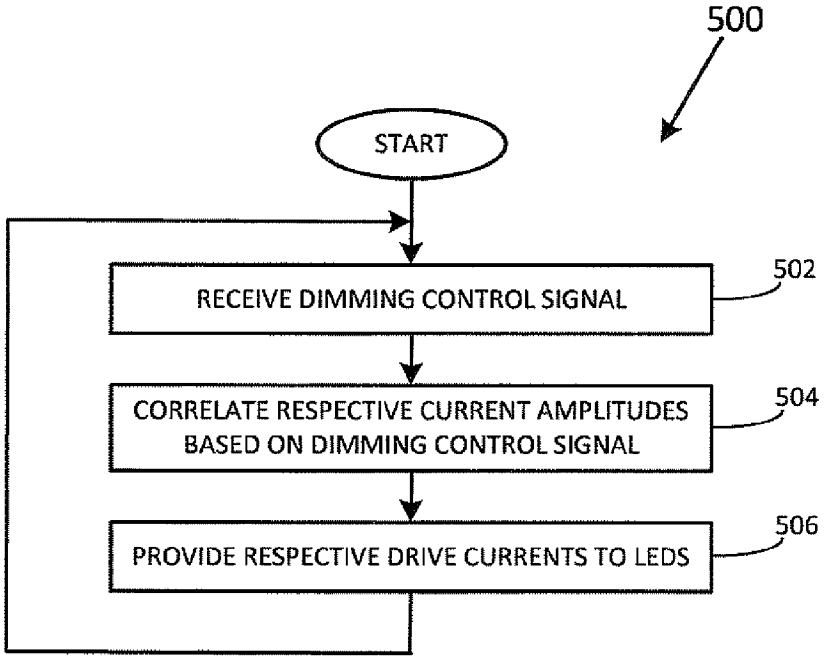
FIG. 5 is a flowchart outlining an example approach for driving a multi-color LED lighting system according to a correlated color temperature adjustment.

FIG. 5 is a flowchart 500 outlining an example approach for driving a multi-color LED lighting system according to a correlated color temperature adjustment. The process starts at 502 where a dimming control signal is received. As discussed above, such a dimming control signal may be a PWM-based signal, but the ultimate form of the dimming control signal can be changed in varying embodiments. Control continues to 504.

At 504, based on the dimming control signal, an amplitude control signal is produced capable of controlling a ratio of cool light produced by one or more first solid state lights having a cool aesthetic color to warm light produced by one or more second solid state lights having a warm aesthetic color. As discussed above, the amplitude control signal may, depending on the embodiment, control a single color signal while allowing the other to be fixed, and may embody any number of transfer functions, such as a transfer function designed to optimize or at least improve upon the CRI of any number of man-made or natural light sources. Control continues to 506.

At 506, based on the dimming signal of 502 and the amplitude control signal of 504, respective drive currents for LEDs may be produced for respective sets of cool-color LEDs and warm-color LEDs for various PWM duty-cycles. Control then jumps back to 502 where the process can continue for as long as may be required or desirable.

While the methods and systems described above are described for two different LED colors, it is to be appreciated that the underlying approach may be extended to three-color systems, such as an RGB LED array, and even to four-color systems, such as RGYB LED array.

While the invention has been described in conjunction with the specific embodiments thereof that are proposed as examples, it is evident that many alternatives, modifications, and variations will be apparent to those skilled in the art. Accordingly, embodiments of the invention as set forth herein are intended to be illustrative, not limiting. There are changes that may be made without departing from the scope of the invention.

What is claimed is:

1. A lighting system, comprising:

one or more first solid state lights having a first aesthetic color;

one or more second solid state lights having a second aesthetic color; and an amplitude correlation circuit configured to control an amplitude ratio of first light produced by the one or more first solid state lights to second light produced by the one or more second solid state lights as a function of a single dimming control signal that determines duty cycles of drive signals driving the one or more first and second solid states lights.

2. The lighting system of claim 1, wherein the second aesthetic color has an appreciably longer wavelength than the first aesthetic color.

3. The lighting system of claim 2, wherein one or more first solid state lights are any of white, blue, green and yellow LEDs, and the one or more second solid state lights are any of red, orange and amber LEDs.

4. The lighting system of claim 3, wherein one or more first solid state lights are white LEDs, and the one or more second solid state lights are red LEDs.

5. The lighting system of claim 1, further comprising driver circuitry configured to produce a pulse-width modulated (PWM) first-color drive signal that drives the one or more first solid state lights and a PWM second-color drive signal that drives the one or more second solid state lights, the relative amplitudes of the drive signals being based on an amplitude control signal provided by the amplitude correlation circuit.

6. The lighting system of claim 5, wherein the relative amplitudes of the drive signals are based also on a PWM duty cycle determined by the received dimming control signal.

7. The lighting system of claim 5, wherein one of the drive signals has a fixed amplitude while the other drive signal has a variable amplitude that varies based on the amplitude control signal.

8. The lighting system of claim 7, wherein the first-color drive signal has a fixed amplitude, and the second-color drive signal has a variable amplitude that varies based on the amplitude control signal.

9. The lighting system of claim 7, wherein the second-color drive signal has a fixed amplitude, and the first-color drive signal has a variable amplitude that varies based on the amplitude control signal.

10. The lighting system of claim 4, wherein the amplitude correlation circuit is configured to control the amplitude ratio of first light to second light in order to mimic Correlated Color Temperature (CCT) for an incandescent light for a plurality of stages of dimming.

11. The lighting system of claim 1, wherein first color is a cool color, and the second color is a warm color.

12. A lighting control method, comprising:

receiving a single dimming control signal; and producing an amplitude control signal configured to control an amplitude ratio of first light produced by one or more first solid state lights having a first aesthetic color to second light produced by one or more second solid state lights having a second aesthetic color as a function of the single dimming control signal that determines duty cycles of drive signals driving the one or more first and second solid states lights.

13. The method of claim 12, wherein the second aesthetic color has an appreciably longer wavelength than the first aesthetic color.

14. The method of claim 13, wherein one or more first solid state lights are any of white, blue, green and yellow LEDs, and the one or more second solid state lights are any of red, orange and amber LEDs.

15. The method of claim 14, wherein one or more first solid state lights are white LEDs, and the one or more second solid state lights are red LEDs.

16. The method of claim 13, further comprising:

based on the amplitude control signal, producing a pulse-width modulated (PWM) first-color drive signal that drives the one or more first solid state lights and a PWM second-color drive signal that drives the one or more second solid state lights, the relative amplitudes of the drive signals being based on an amplitude control signal provided by an amplitude correlation circuit.

17. The method of claim 16, wherein the relative amplitudes of the drive signals are based also on a PWM duty cycle determined by the received dimming control signal.

18. The method of claim 16, wherein one of the drive signals has a fixed amplitude while the other drive signal has a variable amplitude that varies based on the amplitude control signal.

19. The method of claim 18, wherein the first-color drive signal has a fixed amplitude, and the second-color drive signal has a variable amplitude that varies based on the amplitude control signal.

20. The method of claim 18, wherein the second-color drive signal has a fixed amplitude, and the first-color drive signal has a variable amplitude that varies based on the amplitude control signal.

21. The method of claim 16, wherein producing the amplitude control signal includes controlling the amplitude ratio of first light to second light in order to mimic Correlated Color Temperature (CCT) for an incandescent light for a plurality of stages of dimming.

22. The method of claim 12, wherein first color is a cool color, and the second color is a warm color.

* * * * *